US006247207B1

(12) United States Patent
Nitsche

(10) Patent No.: US 6,247,207 B1
(45) Date of Patent: Jun. 19, 2001

(54) ASCOT COLLAR BAR

(76) Inventor: Ludwig C. Nitsche, 605 W. Madison St. - #1912, Chicago, IL (US) 60610-2410

( * ) Notice: Subject to any disclaimer, the term of this patent is extended or adjusted under 35 U.S.C. 154(b) by 0 days.

(21) Appl. No.: 09/406,951

(22) Filed: Sep. 28, 1999

(51) Int. Cl.[7] ..... A41D 25/04

(52) U.S. Cl. ..... 24/66.4; 24/66.2; 24/66.6; 24/66.9

(58) Field of Search ..... 24/66.4, 66.2, 24/66.5, 66.9, 66.3, 66.7, 66.8, 49.1, 545, 563

(56) References Cited

U.S. PATENT DOCUMENTS

| | | | | |
|---|---|---|---|---|
| 1,345,216 | * | 6/1920 | Narbett | 24/66.4 |
| 1,875,251 | | 8/1932 | McKeen . | |
| 1,954,303 | | 4/1934 | Wade . | |
| 1,991,797 | * | 2/1935 | Drinkwater | 24/66.2 |
| 2,001,261 | * | 5/1935 | Manaster | 24/66.2 |
| 2,101,493 | * | 12/1937 | Crain | 24/66.2 |
| 2,150,351 | * | 3/1939 | Ashworth | 24/66.4 |
| 2,306,829 | | 12/1942 | Mutlow . | |
| 2,424,580 | | 7/1947 | Pennock . | |
| 2,465,787 | * | 3/1949 | Bliek | 24/66.2 |
| 2,514,237 | | 7/1950 | Grabowska . | |
| 2,567,216 | | 9/1951 | Lane . | |
| 2,586,215 | | 2/1952 | Federico . | |
| 2,893,086 | * | 7/1959 | Parker | 24/66.6 |
| 3,964,105 | * | 6/1976 | Gideon | 24/49.1 |
| 4,038,724 | * | 8/1977 | Parizek | 24/66.9 |
| 4,553,291 | | 11/1985 | Carey . | |

* cited by examiner

*Primary Examiner*—Victor N. Sakran
(74) *Attorney, Agent, or Firm*—Cook, Alex, McFarron, Manzo, Cummings & Mehler, Ltd.

(57) ABSTRACT

A collar bar that fits within the open collar of a shirt including a first elongated member sized in length to span and hold the open collar of the shirt. A first pair of clips, with one secured to each of the opposite ends of the elongated member, attaches the elongated member to the shirt to maintain the shirt in its open condition. A second pair of clips, each of which is secured to the elongated member near each of the clips of the first pair, secures the opposed lateral edges of the ascot to the collar bar to prevent the ascot from shifting as the knot loosens. The first and second pairs of clips may take various forms, or they may coincide, thereby serving both functions simultaneously, and the elongated member may be adjustable in length.

12 Claims, 2 Drawing Sheets

ASCOT COLLAR BAR

The present invention relates to a men's fashion accessory, and, more particularly, to a collar bar for holding an ascot in place around the neck of the wearer when wearing an open-collar shirt.

BACKGROUND OF THE INVENTION

Clothing fashions constantly change. Yet, over the years, the ascot has remained a stylish accessory for well-groomed men. The ascot is worn on formal occasions with a closed neck shirt on the outside of the shirt collar band (typically in conjunction with a morning coat or cutaway) or, on less formal occasions, with an open collar shirt on the inside of the collar next to the neck, with the ascot being tucked under the shirt front and the neck of the shirt being left open. Formal ascots are usually pre-tied, and equipped with an adjustable clasp on the neck band. The informal ascot, or cravat, must be tied by hand. Henceforth, the term "ascot" will be understood to refer to this latter variety.

Unlike a necktie, which has a wide end and a narrow end, both ends of an ascot form are of the same width and form "bibs" of approximately seven to eight inches in width. The ends are joined together by a narrower waist portion, typically two and one-half to three inches in width, that encircles the wearer's neck when the ascot is tied.

An ascot is tied like a four-in-hand necktie knot, with the omission of the last step in which the wide end of the necktie is drawn through the loop created by wrapping the wide end around the narrow end, cinching down the wide end to form a knot, and drawing up the knot tight to the closed collar. Instead, with the ascot, the front bib rests on top of the loop created by wrapping the waist of the ascot around the rear bib, with the front bib adjusted at the throat to cover the knot. The points of the ascot are then tucked under the shirt front with the neck of the shirt open.

Because the ascot is worn with an open collar and uses a loose knot, several problems arise that present obstacles to the stylish wearing of the ascot.

First, the distance that the collar is open can vary. If the opening narrows, the ascot is obscured; if the opening widens, the ascot becomes visually unmoored and adrift around the neck of the wearer.

Additionally, because the tied ascot does not have a cinched knot, it has a tendency to loosen rather quickly about the wearer's neck, especially when engaged in active pursuits, such as dancing. As the ascot loosens, the bibs disappear from view into the open shirt, exposing the wearer's throat.

Additionally, the width of the ascot bib is such that, for small-necked wearers, it can be difficult to stylishly drape the front bib so that it is puffed-out and elegantly displayed over the throat, while still being comfortably loose around the neck.

Accordingly, it is an object of the present invention to provide a device to be used when wearing an ascot with an open-collared shirt that maintains the collar open a constant, predetermined distance.

It is an additional object of the present invention to provide such a device for use when wearing an ascot that helps to prevent the ascot from slipping down into the open shirt front as the knot loosens.

It is a still further object of the present invention to provide such a device that helps to secure the ascot in position around the wearer's neck and helps to prevent the knot from loosening.

A still further object is to provide such a device for wearing with an ascot that is unobtrusive and substantially hidden from view when in use.

SUMMARY OF THE INVENTION

These objects, as well as others that will become apparent with reference to the accompanying drawings and following detailed description, are provided by a collar bar that fits within the open collar of the shirt that includes a first elongated member sized in length to span the open collar of the shirt. A first pair of clips, with one secured to each of the opposite ends of the elongated member, attaches the elongated member to the shirt to maintain the shirt in its open condition. A second pair of clips, each of which is secured to the elongated member near each of the clips of the first pair, secures the opposed lateral edges of the ascot to the collar bar to prevent the ascot from falling into the open shirt front as the knot loosens. In a particular embodiment, the two pairs of clips may coincide. The clips may comprise, variously, a friction post with a mating friction nut removably attached thereto, alligator clips having a spring-loaded jaw members, a resilient pin having a straight arm and a tension arm folded back thereon, or the like. Further, the first pair of clips may be attached to the elongated member by a chain, so as to permit the collar bar to be secured to the shirt at a location other than the top button/button hole of the shirt. In addition, the elongated member may be adjustable in length, so as to accommodate wearers having differently sized necks.

DETAILED DESCRIPTION OF THE PREFERRED EMBODIMENTS

Figure 1:
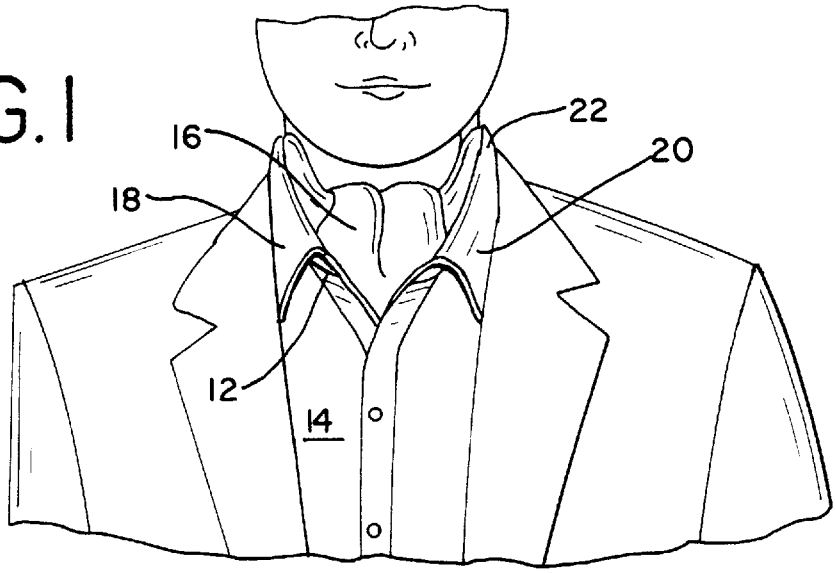
FIG. 1 illustrates the proper wearing of an ascot in an open collar shirt.
Figure 2:
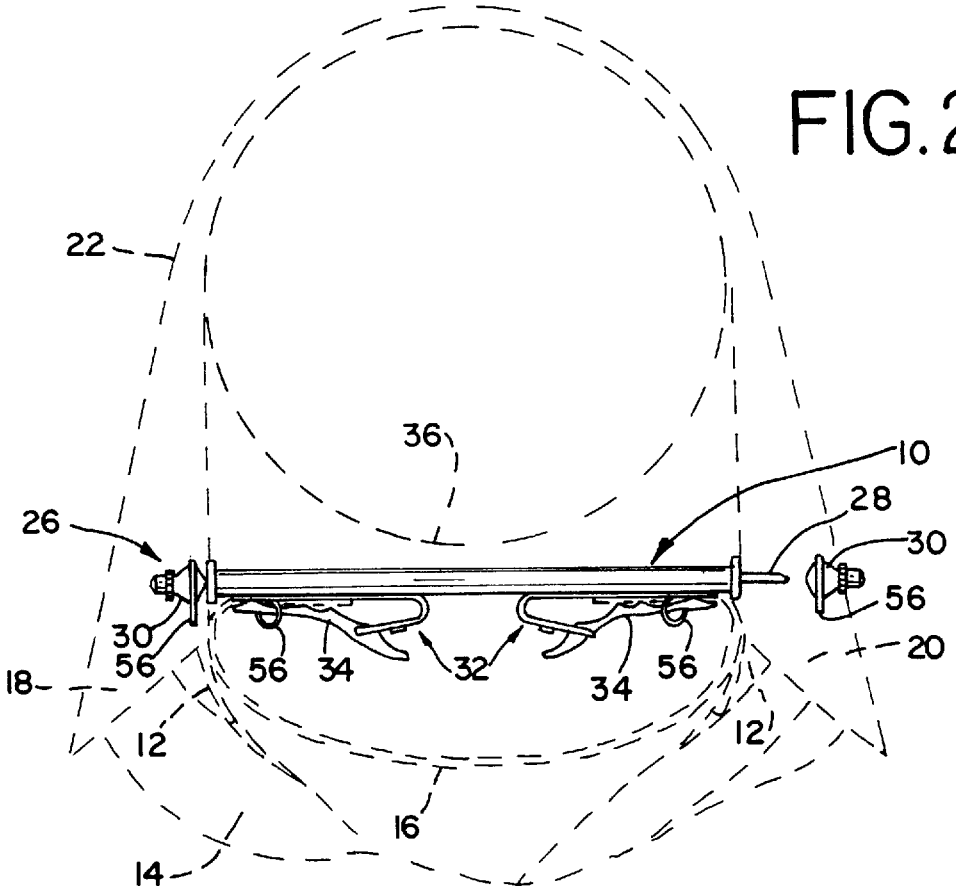
FIG. 2 is a plan view of an ascot bar according to the present invention in which the neck of the wearer, the shirt and shirt collar, and ascot are shown in dashed lines.

Turning to FIGS. 1 and 2 of the drawings, there is seen a collar bar 10 (FIG. 2) in accordance with the present invention. The collar bar 10 is adapted to be attached to the collar band 12 of a shirt 14 adjacent to the top button/button hole of the shirt so that it is substantially hidden by the ascot 16 and the down-folded wings 18, 20 of the shirt collar 22.

As shown in FIG. 2, the collar bar 10 comprises an elongated member 24 sized in length to span the open collar of the shirt 22. The elongated member 24 may vary in length depending upon the neck size of the wearer and the style of shirt being worn. For example, for a wearer having a 15-inch neck with a roll-collar shirt (as illustrated in FIG. 1), a 5-inch length for the elongated member 24 has been found to be satisfactory. The elongated member may be of a variety of materials, such as metal, plastic, or wood and, as illustrated, comprises a cylindrical member.

In accordance with the invention, a first clip 26 is provided on each of the opposite ends of the elongated member 24 for securing the collar bar 10 to the shirt 14, thus maintaining the shirt collar 22 open the distance defined by the elongated member 24. As illustrated in FIG. 2, the first clips 26 each comprise a post 28 with a pointed end for piercing the fabric of the collar bar 12 near the top button/button hole of the shirt 14 and a friction nut 30 that fits over the post 28 to firmly secure the collar bar 10 to the shirt 14.

In keeping with a further aspect of the invention, a second clip 32 is provided on the collar bar 10 adjacent to each of the first clips 26 for securing the ascot 16 to the collar bar 10. With reference again to FIG. 2, the second clips 32 comprise alligator clips of the type commonly used for tie clips, and having spring-loaded jaw members 34 that grasp the opposed lateral edges of the ascot 16 which are rolled under when the ascot 16 is draped over the collar bar 10.

Accordingly, in use, the ascot 16 is tied in the standard manner described above. The front bib of the ascot 16 is lifted up and the collar bar 10 placed underneath and attached to the shirt by means of the clips 26 so that the clips 32 face away from the wearer's neck 36. The collar bar 10 then acts like a "curtain rod" over which the front bib of the ascot is redraped with the opposed lateral edges rolled under so as to be grasped by the clips 32. Thus, the clips 26 of the collar bar 10 are substantially hidden by the wings 18, 20 of the shirt collar, while the remainder of the collar bar 10 is substantially hidden by the front bib of the ascot. Further, by means of the collar bar 10, the ascot is maintained in its desired location despite any loosening of the knot.

Figure 3:
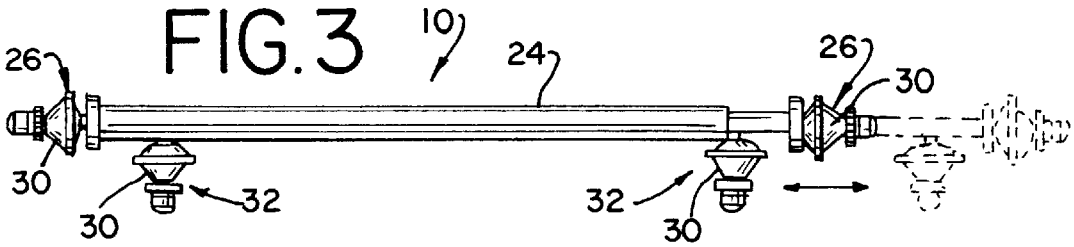
FIG. 3 shows another embodiment of the collar bar of FIG. 2 in which the collar bar is adjustable in length.

Numerous variations of the inventive collar bar 10 are envisioned, some of which are disclosed in the remaining figures of the drawings. For example, the first and second pairs of clips 26, 32 may take any of a variety of forms such as those illustrated in FIGS. 3–6. With reference to FIG. 3, the second pair of clips 32 may also be of the post and friction nut-type described above in conjunction with the clips 26 shown in FIG. 2. In this case, the clips 32 act as a pair of tie-tacs to secure the rolled-under lateral edges of the ascot 16 to the collar bar. Alternatively, the posts of the clips 32 may extend through the outside or visible portion of the ascot 16, in which case the friction nuts 30 are preferably of an ornamental design. The two pairs of clips may also coincide (such as the collar bar illustrated in FIG. 3, except with the clips 32 removed), with the clips 26 serving to attach to both the collar and the ascot.

Figure 4:
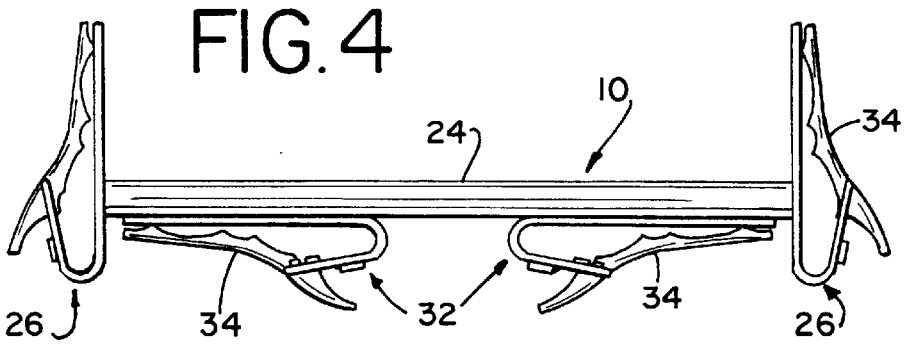
FIG. 4 is a still further embodiment of the collar bar of FIG. 2 in which alligator clips replace the friction post and friction nut used to attach the bar to the shirt collar.

Alternatively, as shown in FIG. 4, the first pair of clips 26 can be of the alligator clip-type described above in conjunction with the clips 32 shown in FIG. 2. In this embodiment, the collar bar 10 is pushed onto the shirt collar so that the jaws 34 of the alligator clips lie along the outside of the collar band 12 to secure the collar bar 10 to the shirt.

Figure 5:
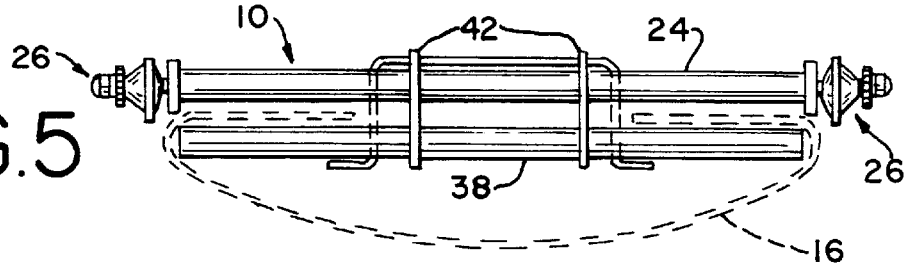
FIG. 5 is a further embodiment of the collar bar in FIG. 2 in which the alligator clips used to secure the ascot to the collar bar are replaced with a second elongated member secured to the first member with elastic loops, and in which the ascot is shown in dashed lines.

Turning to FIG. 5, there is seen a further alternative for the second pair of clips 32 shown in FIGS. 2–4. In this embodiment, the collar bar 10 differs from that in FIG. 2 in that it comprises a second elongated member 38 that is substantially similar to the first elongated member 24. The second elongated member 38 is secured to the first elongated member 24 by means of a rigid, substantially U-shaped wire member 40 that is received through two pairs of aligned holes in the first and second elongated members 24, 38. The wire member 40 permits limited relative parallel movement of the first and second elongated members so that the rolled-under lateral edges of the ascot 16 can be received between the two elongated members. The ends of the wire member 40 are bent 90 degrees so as to lie along the second elongated member and a pair of elastic bands 42 encircle the two elongated members to bias them towards one another, thus providing a clamping force to secure the ascot to the collar bar. While the first pair of clips 26 shown in the FIG. 5 embodiment are of the friction post and nut type, other types of clips such as those disclosed herein may also be used.

Figure 6:
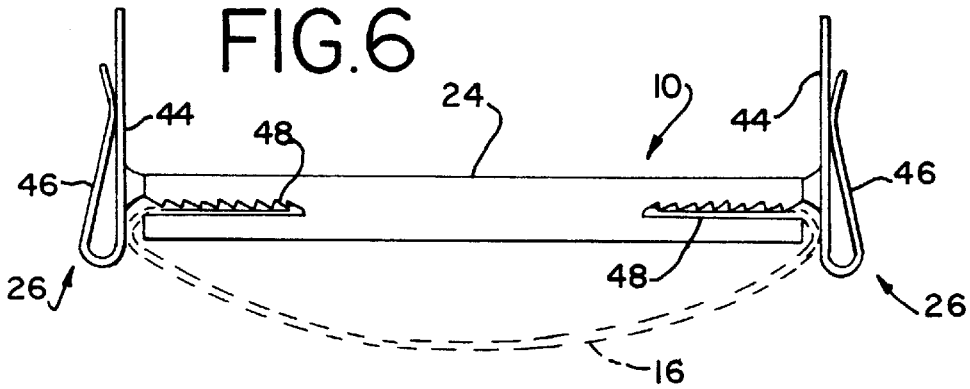
FIG. 6 is a still further embodiment of the collar bar of FIG. 2 in which the friction post and nut are replaced by a resilient pin and the alligator clips are replaced by a slot and the elongated member, and in which the ascot is shown in dashed lines.

A further variation is illustrated in FIGS. 6, where the first clips are resilient pins, like hairpins, which have a straight arm 44 attached to the elongated member 24 and a tension arm 46 folded back thereon. Similar to the embodiment of FIG. 4, the collar bar 10 of FIG. 6 is pushed onto the shirt collar so that tension arms 46 lie on the outside of the collar band 12 and the straight arm 44 lies inside the collar band.

To secure the ascot 16 to the collar bar 10 of FIG. 6, the elongated member 24 has at each of its ends a longitudinally extending slot 48 sized in width to receive the rolled-under edge of the ascot 16. As illustrated in FIG. 6, one side of each slot 48 is serrated to provide teeth for firmly gripping the ascot 16. Alternatively, the slot 48 can be lined with a gripping material to achieve the same result.

Figure 7:
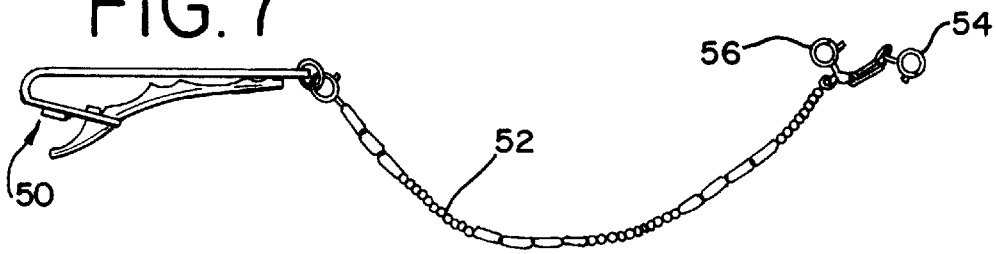
FIG. 7 shows an attachment for use with the collar bar of FIG. 1 that permits the collar bar to be attached to the shirt remote from the top button/button hole of the shirt.

In some situations, the wearer may desire to secure the collar bar 10 by attaching it to the shirt somewhere other than at the top button/button hole. To this end, the first clips 26 may take the form illustrated in FIG. 7, wherein each of the first clips comprises an alligator-type clip 50 suspended on a chain 52, with the loose end of the chain having a spring-loaded circular clasp 54 for attaching the chain to the collar bar 10. With reference to FIG. 2, the first and/or second clips 26, 32 may be provided with optional attachment loops 56 (shown attached to the friction nuts 30 and the jaw members 34) to permit attachment of the chain-suspended clips 50 by use of the clasp 54. Consequently, the clips 50 can be attached to the collar of the shirt at the sides of the neck so that the elongated member 24 of the collar bar 10 is suspended between the forward edges of the collar crosswise underneath the front bib of the ascot 16. The chain 52 can be provided with an additional clasp 56 on an intermediate portion that serves to gather-up the chain at an arbitrary point to allow adjustment of its length.

As noted above, the preferred length of the collar bar 10 may vary depending upon the size of the wearer's neck and the style of shirt being worn. Accordingly, it is desirable to provide a collar bar 16 according to the present invention that is adjustable in length to accommodate such variations. With reference again to FIG. 3, a variable-length collar bar 10 is illustrated in which the first elongated member 24 is tubular and includes a telescoping member 24*a* carrying one of each of the first and second clips 26, 32. The telescoping member 24*a* slides in and out of the elongated member 24 to the desired length, with the relative positions of the tubular elongated member 24 and telescoping member 24*a* being maintained by friction between the two. Alternatively, other, more positive locking detents can be provided such as are well known in the art.

In practice, the collar bar may be constructed of brass tubing, with tie tacs and tie pins used for the first and second clips, and the assemblage being cold-soldered together.

However, other materials and components may also be used without departing from the invention.

Thus, a collar bar for use with an ascot has been disclosed that makes the wearing of ascots easy, comfortable, and practical. Further, the disclosed collar bar improves the appearance of the ascot and substantially eliminates the need for constant retying and adjustment of the ascot due to the loosening of the knot, particularly when engaged in active pursuits, such as dancing. While the invention has been described in conjunction with certain preferred embodiments, there is no intent to limit the invention to the same. Instead, the invention is defined by the scope of the appended claims.

What is claimed:

1. A collar bar for holding an ascot having opposed lateral edges in place around the neck of a wearer when wearing an open-collar shirt, the collar bar comprising:

a first elongated member having opposite ends sized in length to span the open collar of the shirt;

a first pair of clips, one of the said first pair of clips being secured to each of the opposite ends of the first elongated member for attaching the elongated member to the shirt thereby maintaining the collar of the shirt in an open condition; and a second pair of clips, one of the said second pair of clips being secured to the first elongated member proximate to each of the clips of the first pair, said second pair of clips for attaching to the opposed lateral edges of the ascot, thereby preventing the ascot from falling into the open shirt as its knot loosens.

2. The collar bar of claim 1 wherein the clips of the first pair comprise a friction post having a friction nut removably attached thereto.

3. The collar bar of claim 1 wherein the clips of the first pair comprise an alligator clip having a spring-loaded jaw member.

4. The collar bar of claim 1 wherein the clips of the first pair comprise a resilient pin having a straight arm and a tension arm folded back thereon.

5. The collar bar of claims 3 or 4 wherein each of the first pair of clips is attached to the elongated member by a chain.

6. The collar bar of claim 5 wherein the chains are adjustable in length.

7. The collar bar of claims 1, 2, 3, or 4 wherein the clips of the second pair comprise a friction post with a friction nut removably attached thereto.

8. The collar bar of claims 1, 2, 3, or 4 wherein the clips of the second pair comprise an alligator clip having a spring-loaded jaw.

9. The collar bar of claims 1, 2, 3, or 4 wherein the clips of the second pair comprise a resilient pin having a straight arm and a tension arm folded back thereon.

10. The collar bar of claims 1, 2, 3, or 4 wherein the clips of the second pair comprise a slot sized to receive the edge of the ascot.

11. The collar bar of claims 1, 2, 3, or 4 wherein the second pair of clips comprises a second elongated member substantially the same length as the first elongated member, the second elongated member being secured in substantially parallel relationship to and biased into contact with said first elongated member by elastic loops so that the opposed lateral edges of the ascot can be held at the opposite ends of the first and second elongated members in between the first member and the second member.

12. The collar bar of claim 1 wherein the elongated member is adjustable in length.

* * * * *